US007418801B2

(12) United States Patent
Loveless

(10) Patent No.: US 7,418,801 B2
(45) Date of Patent: Sep. 2, 2008

(54) STANDING SEAM-MOUNTED GUTTER BRACKET

(76) Inventor: James Loveless, 17905 Airmont Rd., Round Hill, VA (US) 20141

( * ) Notice: Subject to any disclaimer, the term of this patent is extended or adjusted under 35 U.S.C. 154(b) by 274 days.

(21) Appl. No.: 11/101,602

(22) Filed: Apr. 8, 2005

(65) Prior Publication Data

US 2006/0225366 A1 Oct. 12, 2006

(51) Int. Cl.
*E04D 13/00* (2006.01)
*E04D 13/072* (2006.01)

(52) U.S. Cl. ..... 52/11; 248/48.2

(58) Field of Classification Search ..... 52/11, 52/12, 24–26, 37; 248/48.1, 48.2; 403/236
See application file for complete search history.

(56) References Cited

U.S. PATENT DOCUMENTS 1,054,091 A * 2/1913 Darnall ..... 248/237
1,558,385 A 10/1925 Meunier
2,004,448 A 6/1935 Sansonetti
2,631,801 A 3/1953 Toal
2,647,476 A * 8/1953 Gibbons ..... 405/123
3,809,347 A 5/1974 Pekarek
4,940,198 A 7/1990 De Wilde
6,256,934 B1 * 7/2001 Alley ..... 52/25
6,453,623 B1 * 9/2002 Nelson et al. ..... 52/24
6,715,256 B1 4/2004 Fischer
6,834,466 B2 * 12/2004 Trevorrow et al. ..... 52/24

FOREIGN PATENT DOCUMENTS

FR 2580703 A1 * 10/1986 ..... 52/11
JP 03013649 A * 1/1991 ..... 52/11
JP 5331987 12/1993

* cited by examiner

*Primary Examiner*—Brian Glessner
*Assistant Examiner*—Adriana Figueroa
(74) *Attorney, Agent, or Firm*—Richard C. Litman

(57) ABSTRACT

A bracket and strap assembly that permits a gutter to be attached to a standing seam on a metal roof without the use of roof-piercing screws and/or nails. A unitary bracket is mounted on the standing seam. A gutter-supporting strap is attached to the bracket. All attachments are made with set-screws.

4 Claims, 2 Drawing Sheets

STANDING SEAM-MOUNTED GUTTER BRACKET

BACKGROUND OF THE INVENTION

1. Field of the Invention

The present invention generally relates to supports. More specifically, the present invention is drawn to a bracket for supporting a gutter from a metal roof.

2. Description of the Related Art

Installing gutters on metal roofs can create a myriad of problems if the installer uses nails or screws to pierce the metal roof. Such piercing creates holes that can widen as a result of normal expansion and movement. Consequently, leakage through the roof may occur through the widened holes. An efficient system for mounting gutters to metal roofs would be a welcome addition to the art.

A sampling of systems for mounting gutters to roofs is cited and identified in the accompanying IDS. However, none of the above inventions and patents, taken either singly or in combination, is seen to disclose a mounting bracket system as will be subsequently described and claimed in the instant invention.

SUMMARY OF THE INVENTION

The present invention is a bracket and strap assembly that permits a gutter to be attached to a standing seam on a metal roof without the use of roof-piercing screws and/or nails. A unitary bracket is mounted on the standing seam. A gutter-supporting strap is attached to the bracket. All attachments are made with setscrews.

Accordingly, the invention presents a bracket and strap assembly that is rugged, efficiently designed and easy to use. The invention provides for improved elements thereof in an arrangement for the purposes described that are inexpensive, dependable and fully effective in accomplishing their intended purposes.

A clear understanding of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENT

Figure 1:
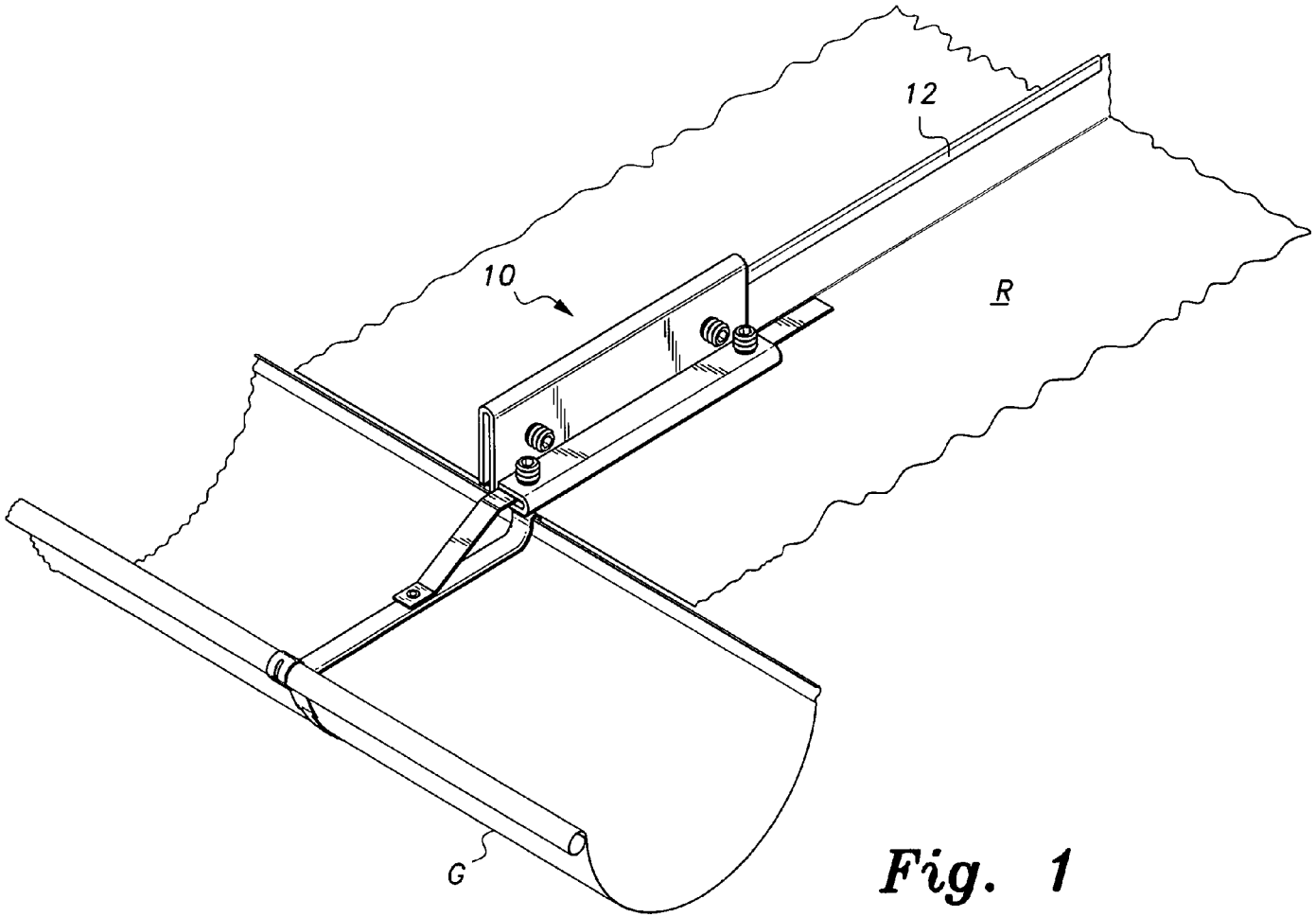
FIG. 1 is an environmental, perspective view of a standing seam mounted gutter bracket and strap assembly according to the present invention.

Attention is first directed to FIG. 1 wherein the bracket and strap assembly of the present invention is generally indicated by the reference character 10. The assembly 10 is utilized to support gutter G adjacent the edge of a metal roof R, which roof is constructed with a standing seam 12. A bracket 14 is designed for mounting to standing seam 12. A strap assembly 30 is attached to the bracket and supports the gutter G.

Figure 2:
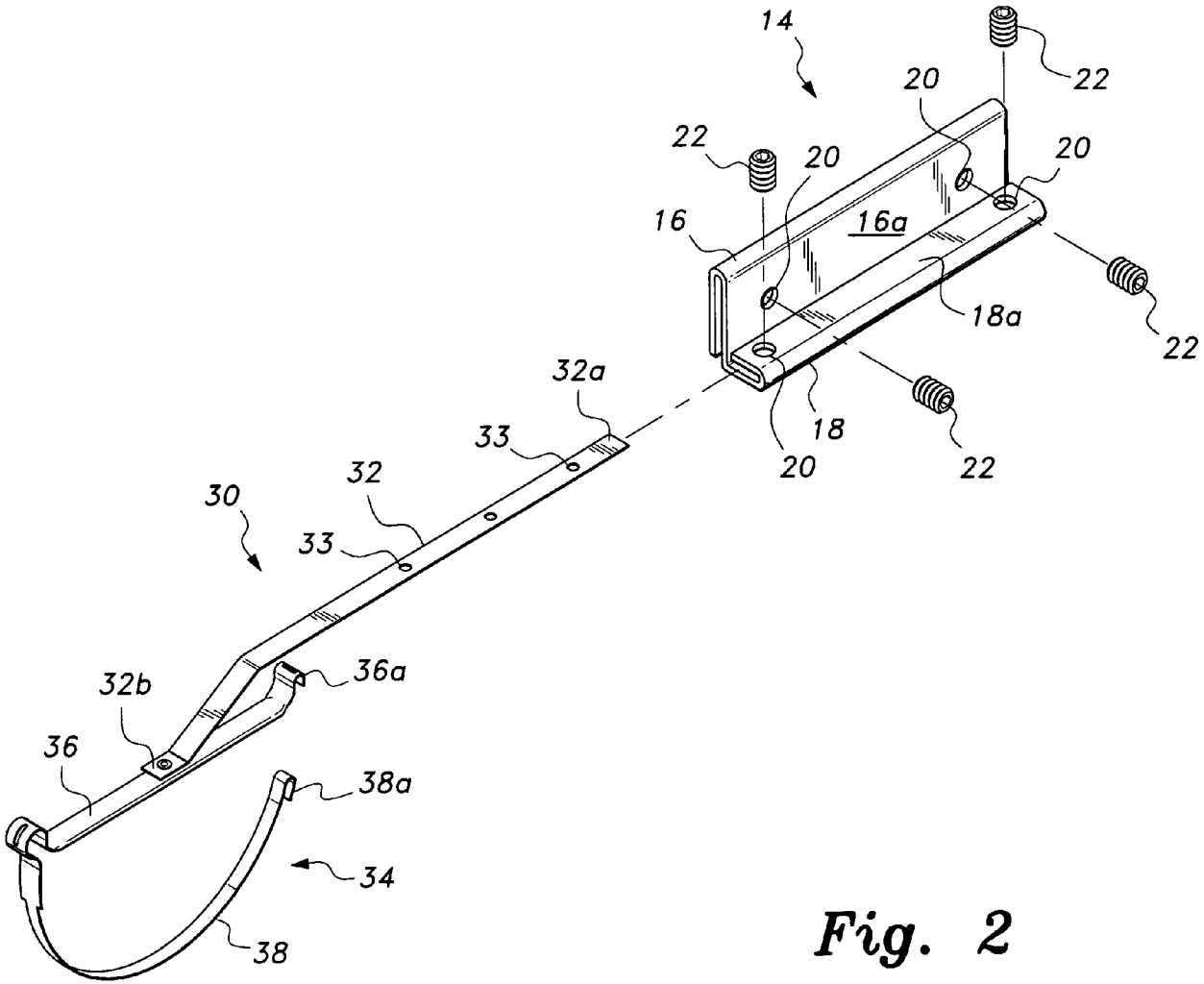
FIG. 2 is an exploded, perspective view of a standing seam mounted gutter bracket and strap assembly according to the present invention.

As best seen in FIG. 2, bracket 14 is fabricated from a single piece of metal stock and configured with two U-shaped portions 16 and 18. Portions 16 and 18 are arranged perpendicularly to each other and each U-shape defines a slot. Each portion is provided with a respective sidewall 16*a* and 18*a*. Each sidewall 16*a*, 18*a* has threaded openings 20 disposed therein, which openings 20 are adapted to receive set screws 22 therein for purposes as will be explained below.

Strap assembly 30 is fabricated from metal and comprises an elongate strip 32 having a distal end 32*a* and a proximate end 32*b*. Distal end 32*a* is received in U-shaped portion 18. Proximate end 32*b* is attached to a gutter-encircling portion 34. Threaded openings 33 are spaced a pre-determined distance along the length of strip 32 and are spaced to correspond with the openings 20 in wall 18*a*. Gutter-encircling portion 34 is provided with a rear face 36 and a front face 38, which front face has a radius of curvature. Rear face 36 terminates in a free end having a slot 36*a* therein. Front face 38 also terminates in a free end, which free end is configured as a hook 38*a*. Although metal is the preferred material for all the above parts, it is recognized that other suitable materials, i.e. plastic, may be employed.

In use, U-shaped portion 16 of bracket 14 is mounted on standing seam 12. The openings 20 in wall 16*a* receive setscrews 22 to secure the bracket to the standing seam. End 32*a* of strip 32 is inserted in the slot formed by U-shaped portion 18. The strip is adjusted in the slot to allow portion 34 to encircle gutter G. When properly adjusted, setscrews 22 are inserted in openings 20 and 33 in wall 18*a* and strip 32 respectively, to secure the strip in the bracket. Hook 38*a* is then inserted in slot 36*a* to secure the gutter in encircling portion 34.

It is to be understood that the present invention is not limited to the embodiment described above, but encompasses any and all embodiments within the scope of the following claims.

I claim:

1. A gutter mounting assembly, comprising:

a bracket;

a first U-shaped portion formed on said bracket, said first U-shaped portion projecting along a substantially vertical direction such that a standing seam of a roof may be received within the first U-shaped portion for mounting of the bracket on the roof, said first U-shaped portion having an open lower end and a closed upper end and defining a first recess therein, the standing seam being received through the open lower end, within the first recess;

a second U-shaped portion formed on said bracket, said second U-shaped portion arranged perpendicularly to said first U-shaped portion, said second U-shaped portion projecting along a substantially horizontal direction such that the second U-shaped portion is positioned parallel to a plane of the roof, said second U-shaped portion having opposed open and closed ends and defining a second recess therein, the open end thereof being positioned adjacent the first U-shaped portion;

an elongate strip, said elongate strip having a distal end and a proximate end, wherein said distal end is attached to said second U-shaped portion of said bracket, said elongate strip having a substantially planar contour and being received within said second U-shaped portion such that said elongate strip is positioned parallel to the plane of the roof;

a gutter-encircling portion, said gutter encircling portion attached to said proximate end of said elongate strip, said gutter-encircling portion including a rear face, said rear face terminating in a free end and a front face, said front face having a radius of curvature and terminating in a free end, a recess being formed in the free end of said rear face and a hook being formed on said free end of said front face, said hook releasably engaging said recess.

2. In combination with a metal roof having at least one raised seam thereon, a gutter mounting assembly, comprising:

a bracket;

a first U-shaped portion formed on said bracket said first U-shaped portion mounted on said raised seam, said first U-shaped portion projecting along a substantially vertical direction such that the raised seam of the roof may be received within the first U-shaped portion for mounting of the bracket on the roof, said first U-shaped portion having an open lower end and a closed upper end and defining a first recess therein, the raised seam being received through the open lower end, within the first recess;

a second U-shaped portion formed on said bracket, said second U-shaped portion arranged perpendicularly to said first U-shaped portion, said second U-shaped portion projecting alone a substantially horizontal direction such that the second U-shaped portion is positioned parallel to a plane of the roof, said second U-shaped portion having opposed open and closed ends and defining a second recess therein, the open end thereof being positioned adjacent the first U-shaped portion;

an elongate strip, said elongate strip having a distal end and a proximate end, wherein said distal end is attached to said second U-shaped portion of said bracket, said elongate strip having a substantially planar contour and being received within said second U-shaped portion such that said elongate strip is positioned parallel to the plane of the roof;

a gutter-encircling portion, said gutter encircling portion attached to said proximate end of said elongate strip, said gutter-encircling portion including a rear face, said rear face terminating in a free end and a front face, said front face having a radius of curvature and terminating in a free end, a recess being formed in the free end of said rear face and a hook being formed on said free end of said front face, said hook releasably engaging said recess.

3. The gutter mounting assembly as recited in claim 2, wherein each U-shaped portion has a sidewall and including threaded openings in each said sidewall.

4. The gutter mounting assembly as recited in claim 2, including threaded openings spaced along the length of said elongate strip.

* * * * *